US006183027B1

(12) United States Patent
Tsao

(10) Patent No.: US 6,183,027 B1
(45) Date of Patent: Feb. 6, 2001

(54) FOLDABLE FAST-FOOD CARRYING DEVICE

(76) Inventor: Chung-Piao Tsao, 4F, No. 22, Lane 346, Kuang-Fu S. Road, Taipei (TW)

( * ) Notice: Under 35 U.S.C. 154(b), the term of this patent shall be extended for 0 days.

(21) Appl. No.: 09/264,542

(22) Filed: Mar. 5, 1999

(51) Int. Cl.[7] ..... B65D 71/00

(52) U.S. Cl. ..... 294/146; 206/194; 206/549; 294/87.2

(58) Field of Search ..... 294/87.1, 87.2, 294/143, 144, 146, 159, 162, 163, 165, 172; 206/146, 151, 158, 194, 427, 549, 557, 562, 564; 220/23.83; 229/117.14

(56) References Cited

U.S. PATENT DOCUMENTS 2,298,209 * 10/1942 Gray ..... 294/87.2
3,640,380 * 2/1972 Huffman ..... 294/146 X
4,273,273 * 6/1981 Zenri ..... 294/87.2
5,127,519 * 7/1992 Tsao ..... 206/549 X
5,267,644 * 12/1993 Tsao ..... 294/87.2 X
5,743,389 * 4/1998 Cutler et al. ..... 206/194 X
5,775,503 * 7/1998 LeBras ..... 206/427
5,957,276 * 9/1999 Cutler et al. ..... 206/194

* cited by examiner

*Primary Examiner*—Johnny D. Cherry

(57) ABSTRACT

A foldable fast-food carrying device includes: a paper board having a front and a rear wall upwardly folded from a bottom wall, at least a side cover hingedly secured to a side portion of the carrying device, a circular hole cut out in the bottom wall for loading a cup of soft drink in the circular hole, at least a partition member bent upwardly from an edge portion of the circular hole to serve as a partition between the soft drink and a hamburger or French-fries container stored in the carrying device, and several bottom locations provided on or in the bottom wall for storing the hamburger and French-fries container to be shielded by the side cover, and a pair of handle members respectively protruding from the front and rear walls for confining the fast foods within the carrying device. The two handle members are interlocked for conveniently carrying the fast foods as stored within the carrying device.

5 Claims, 8 Drawing Sheets

FIG. 3
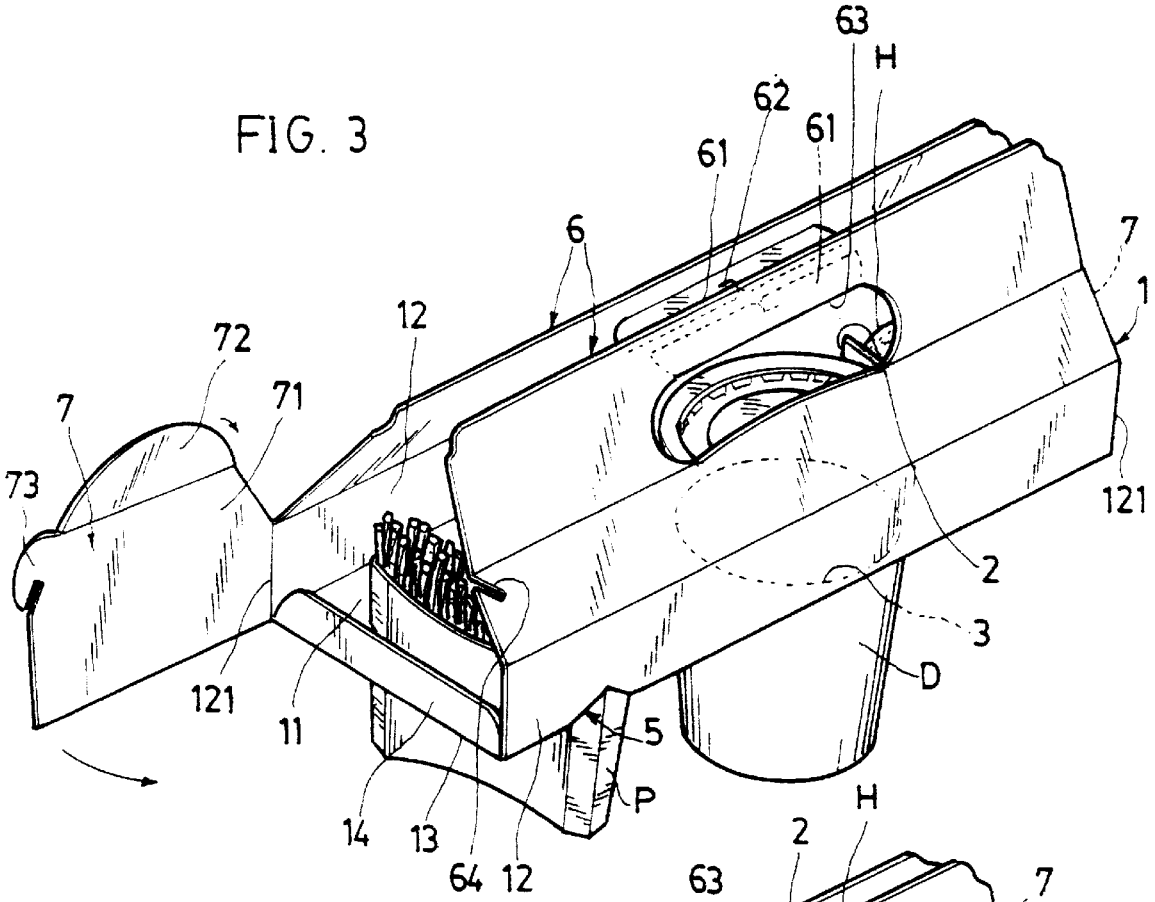
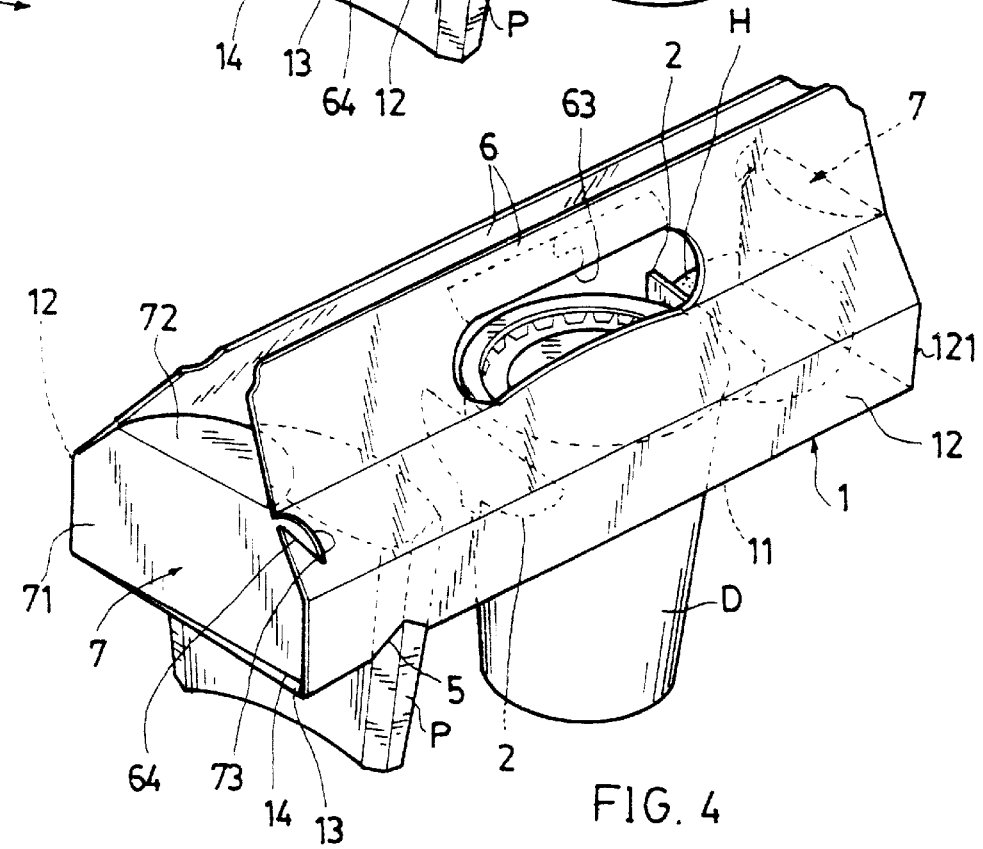
FIG. 4

FOLDABLE FAST-FOOD CARRYING DEVICE

BACKGROUND OF THE INVENTION

When carrying fast foods or snacks from a fast-food shop such as McDonald, Wendy's, Lotteria, etc., a paper or plastic bag may be always provided for storing the hamburger, soft drink and French fries or potato chips for take-away use.

However, the hot hamburger may be easily cooled down or getting wet by the cold drink such as coke or soda, influencing the quality and feeling when enjoying and eating the fast food. Also, the drink cup may also be easily turned over or collapsed within the soft bag to wet or spoil the foods and drink, causing embarrassment and inconvenience accordingly.

U.S. Pat. No. 5,267,644 issued to the same inventor of this application disclosed a tuckable carrier means having a plurality of container holes formed in a base plate portion, of which the plurality of container holes may be suitably loaded with drink cups such as coke or soda. However, it is not suitable for storing other fast foods such as hamburger and French fries by such a carrier.

Therefore, the present inventor has invented the fast-food carrying device for simultaneously carrying the hamburger, the soft drink and the French fries within the carrying device.

SUMMARY OF THE INVENTION

The object of the present invention is to provide a foldable fast-food carrying device including: a paper board having a front and a rear wall upwardly folded from a bottom wall, at least a side cover hingedly secured to a side portion of the carrying device, a circular hole cut out in the bottom wall for loading a cup of soft drink in the circular hole, at least a partition member bent upwardly from an edge portion of the circular hole to serve as a partition between the soft drink and a hamburger or French-fries container stored in the carrying device, and several bottom locations provided on or in the bottom wall for storing the hamburger and French-fries container to be shielded by the side cover, and a pair of handle members respectively protruding from the front and rear walls for confining the fast foods within the carrying device, with the two handle members interlocked for conveniently carrying the fast foods as stored within the carrying device.

BRIEF DESCRIPTION OF THE DRAWINGS

FIG. 3 is an illustration of the present invention when assembled, but remaining an opened side cover.

FIG. 4 is an illustration when closing the side cover from FIG. 3.

DETAILED DESCRIPTION

Figure 1:
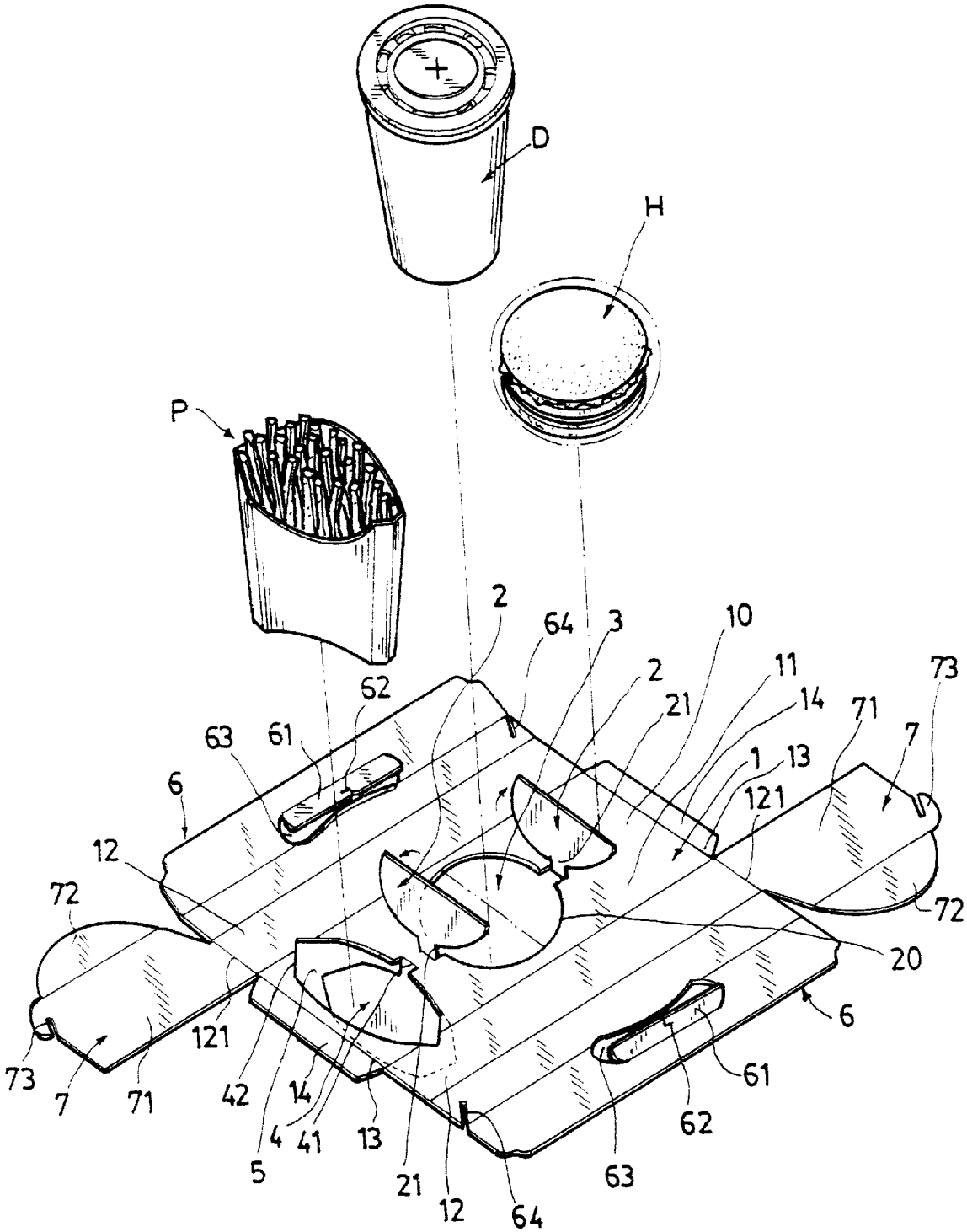
FIG. 1 is an exploded view of the present invention before being folded.

As shown in FIG. 1~4, the foldable fast-food carrying device of the present invention comprises: a paper board, sheet or plastic sheet 1 having a front wall and a rear wall 12 respectively folded upwardly from a bottom wall 11 of the board 1, a pair of side extensions 14 bent upwardly from opposite side edges 13 of the bottom wall 11; a pair of handle members 6 respectively protruding from the front and rear walls 12, 12; and a pair of side covers 7 respectively hingedly secured to the front and rear walls 12, 12.

A pair of partition members 2, 2 are upwardly bent from opposite edge portions of a circular hole 3 when cut out along a circular line 20 on a central portion of the bottom wall 11, each partition member 2 formed as a semi-circular shape and hingedly secured to the bottom wall 11 by a hinge portion 21 which is directly cut out from the bottom wall 11. The circular line 20 may be perforated or dotted line for easy tearing of the two partition members 2, 2 from the circular line 20 on the bottom wall 11.

The circular hole 3 is cut out in a central portion of the bottom wall 11 for loading a cup of soft drink D such as coke or soda into the hole 3. The drink D is heavier in comparison with hamburger 11 and French-fries container or box P so that the drink D is loaded in the hole 3 located at a central portion of the bottom wall 11 of the carrying device 1 of the present invention for a better gravitational balance.

Figure 2:
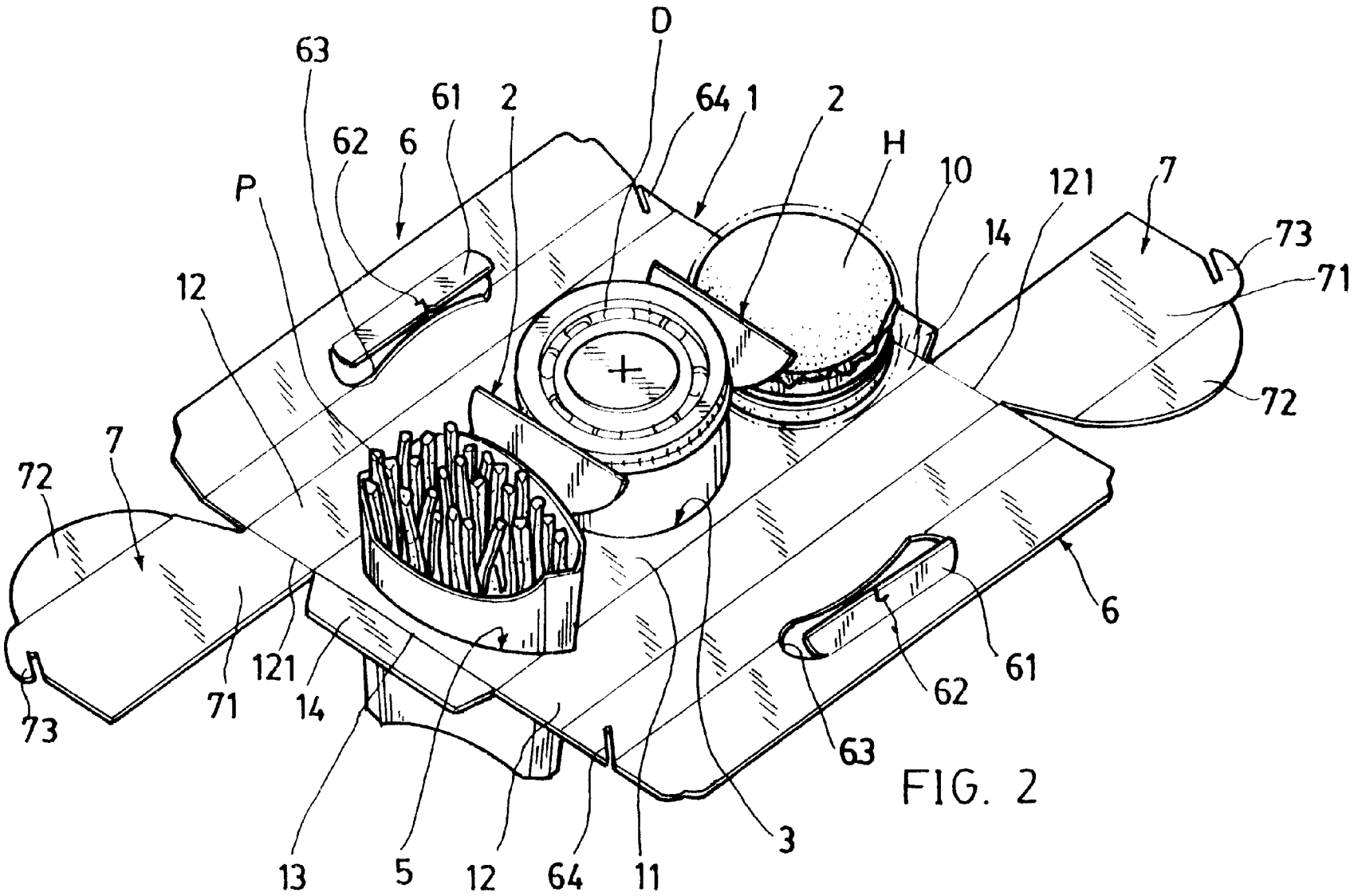
FIG. 2 is an illustration when loaded with fast foods thereon.

A tearable leaf 4 is formed in the bottom wall 11 adjacent to a side edge 13 of the bottom wall 11 along a tearing line 42 which may be a perforated or dotted line of oval shape, polygonal or other irregular shapes, whereby upon a downward protrusion of the tearable leaf 4 along the tearing line 42 as shown in FIG. 1, a slot 5 will be formed in the bottom wall for loading a French-fries container or box P therein (FIG. 2).

Each handle member 6 includes: a flap 61 cut out in the handle member 6 to form a hand hole or finger hole 63, having a locking tab formed on each flap 61 by cutting a slit 62 which may be L shape or T shape cut in a central portion of the flap 61, whereby upon an interlocking of two flaps 61 of the two handle members 6 by engaging two locking tabs of the two flaps 61 as shown in FIGS. 3, 4, the two handle members 6 will then be combined and interlocked to serve as a handle for an easy carrying by passing a user's hand or fingers through the handhole (finger hole) 63 cut out in the handle members 6.

Each side cover 7 includes: a side lid 71 hingedly secured to either a rear wall or a front wall 12 along a folding line 121 vertically formed on a side edge of the rear or front wall 12, a top flap 72 formed on an upper portion of the side lid 71 and horizontally bent for shielding either a French-fries container P or a hamburger H stored on a bottom wall 11 or a flat bottom portion 10 on the bottom wall 11 when closing the side cover 7 as shown in FIGS. 3, 4 by engaging a locking lug 73, which is formed on an upper corner portion of the side lid 71 opposite to the folding line 121, with an engaging slit 64 formed in the handle member 6 adjacent to the front or rear wall 12. Upon folding of each side cover 7 between the front and rear walls 12, a side opening between the front and rear walls will be closed.

Therefore, the cup of drink D may be loaded into the circular hole 3; and the French-fries container or box P may be loaded into the slot 5 positioned at a left portion of the circular hole 3 as thermally insulated by a left partition member 2 upwardly bent from a left edge portion of the circular hole 3; and the hamburger H may be stored on the flat bottom portion 10 of the bottom wall 11 as thermally insulated by the right-side partition member 2; whereby upon folding of the carrying device of the present invention by upwardly erecting the front and rear walls 12, by interlocking the two handle members 6, and by closing the two side covers 7, the French-fries container P will be firmly held or clamped between the left-side side cover 7 and the left-side partition member 2 as shown in FIG. 4, while the hamburger H will be firmly held or clamped between the right-side side cover 7 and the right-side partition member 2.

Accordingly, this invention is superior to the prior art or conventional fast-food container with the following advantages:

1. The partition members are instantly formed in situ from the bottom wall to serve as thermally insulating media between the cold coke drink and the hot hamburger or French fries, without influencing the quality and feeling when enjoying the fast foods.
2. One-piece paper board 1 can be directly formed to store the drink D, the French fries P and hamburger H together in the carrying device as directly folded from the board 1, saving the production cost.
3. The carrying device may be easily and fastly folded for carrying fast foods therein for a smooth convenient take-away service from a fast-food shop since all foods and drink are stably held on the carrying device, without worry about turning over, collapse or falling down of the foods or drink, thereby providing a better feeling for enjoying the fast foods or snacks.

The present invention may be further modified without departing from the spirit and scope of the present invention.

Figure 11:
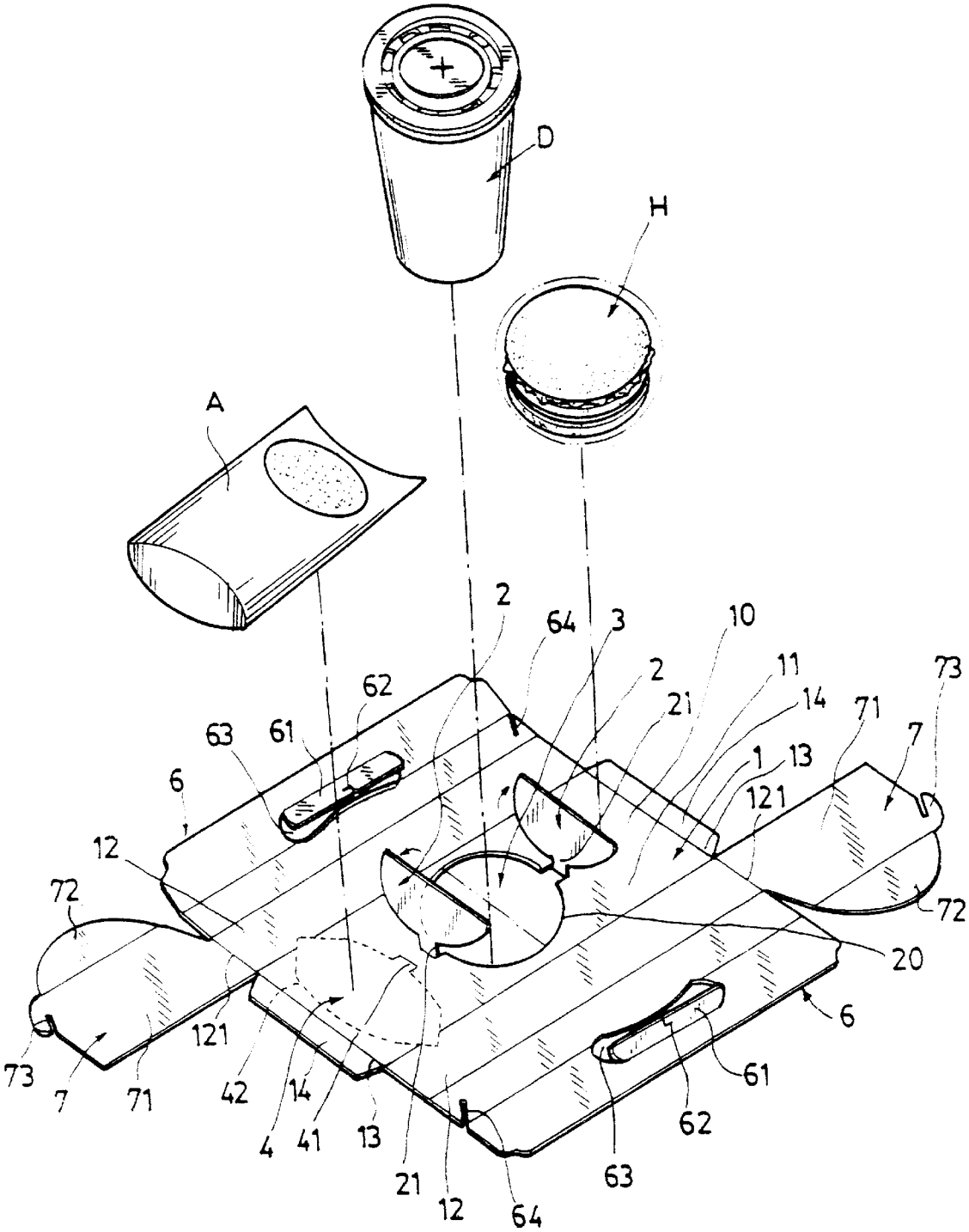
FIG. 11 is a modification from FIG. 1 without forming a bottom slot and having a pie stored on the bottom of the carrying device.

As shown in FIG. 11, the slot 5 may not be formed without punching off the tearable leaf 4 so that an apple pie A may be stored on the bottom wall 11.

Figure 5:
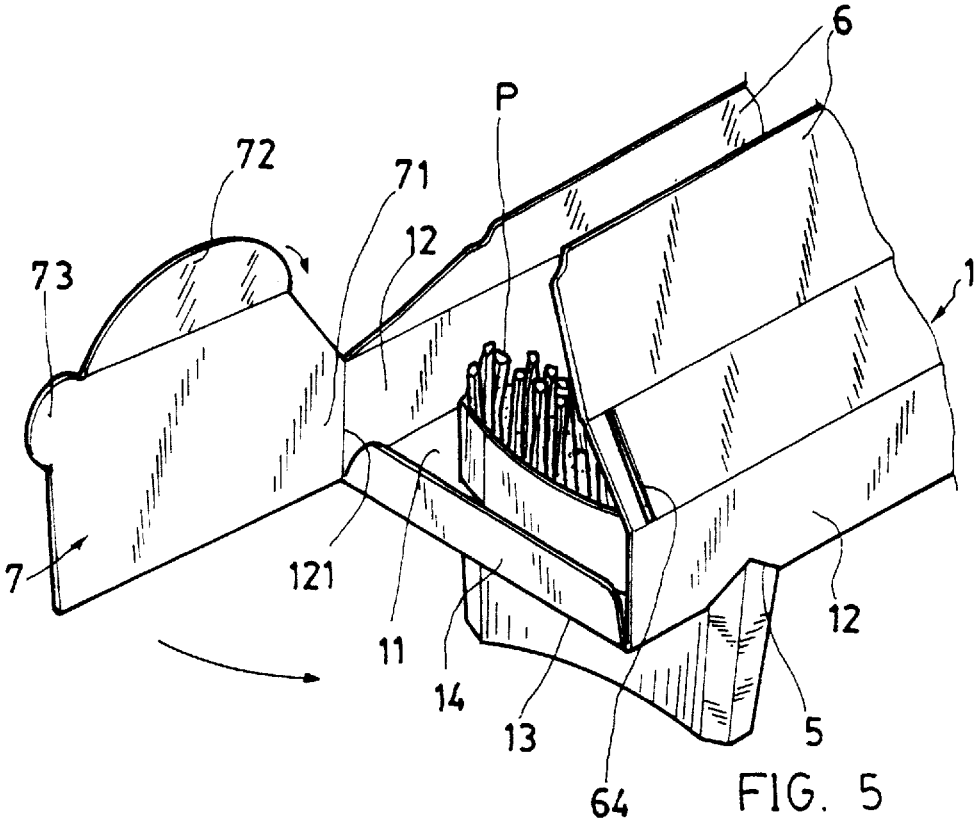
FIG. 5 shows another preferred embodiment of the present invention when opening a side cover.
Figure 6:
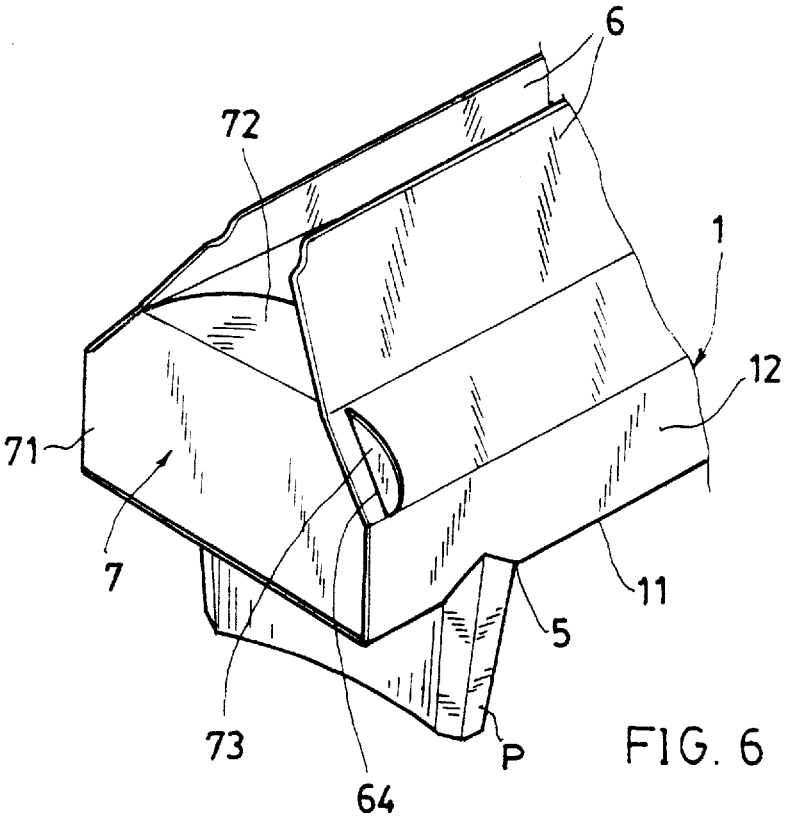
FIG. 6 shows the closed side cover from FIG. 5.
Figure 7:
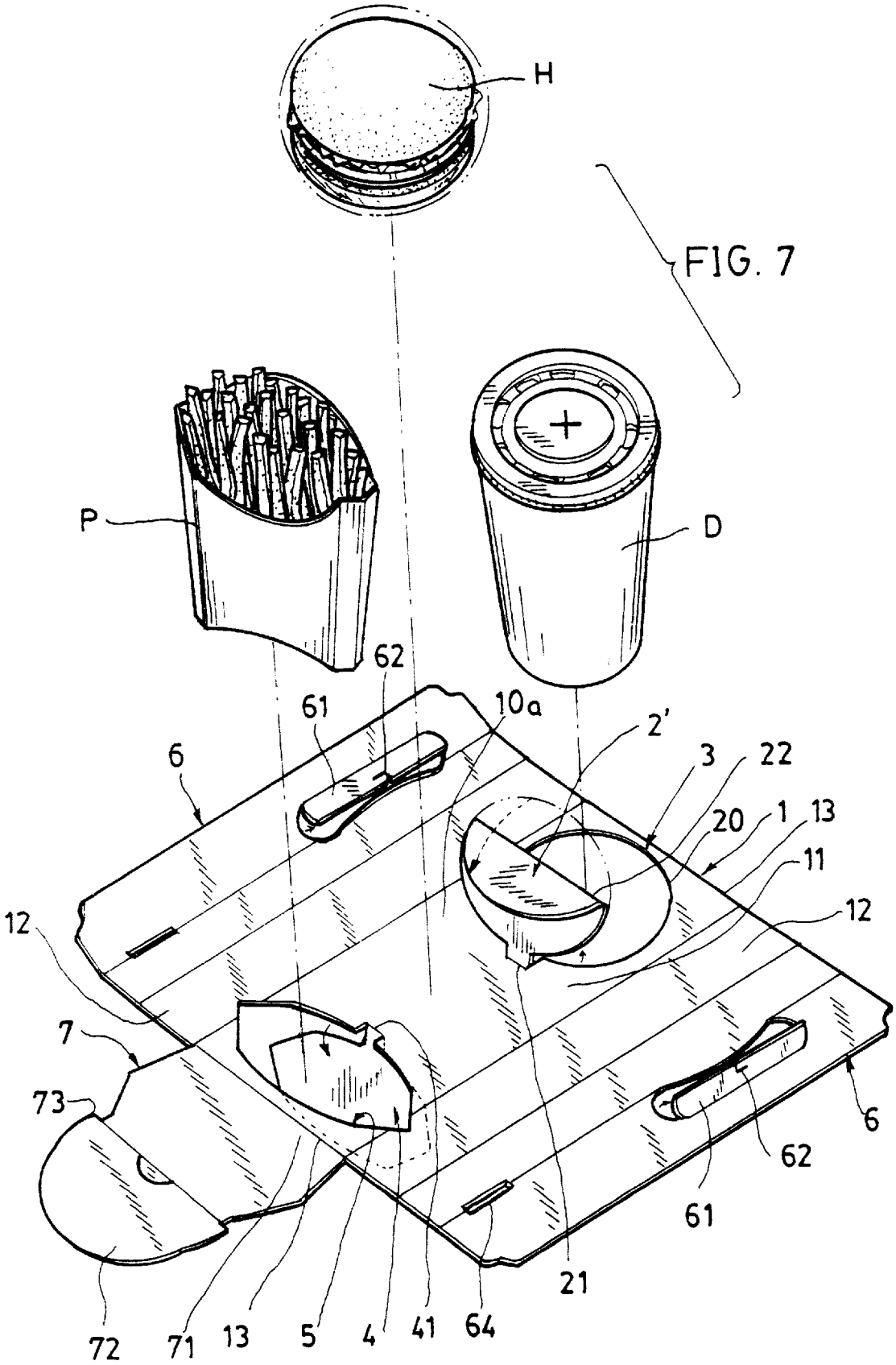
FIG. 7 is an exploded view showing still another preferred embodiment of the present invention.
Figure 8:
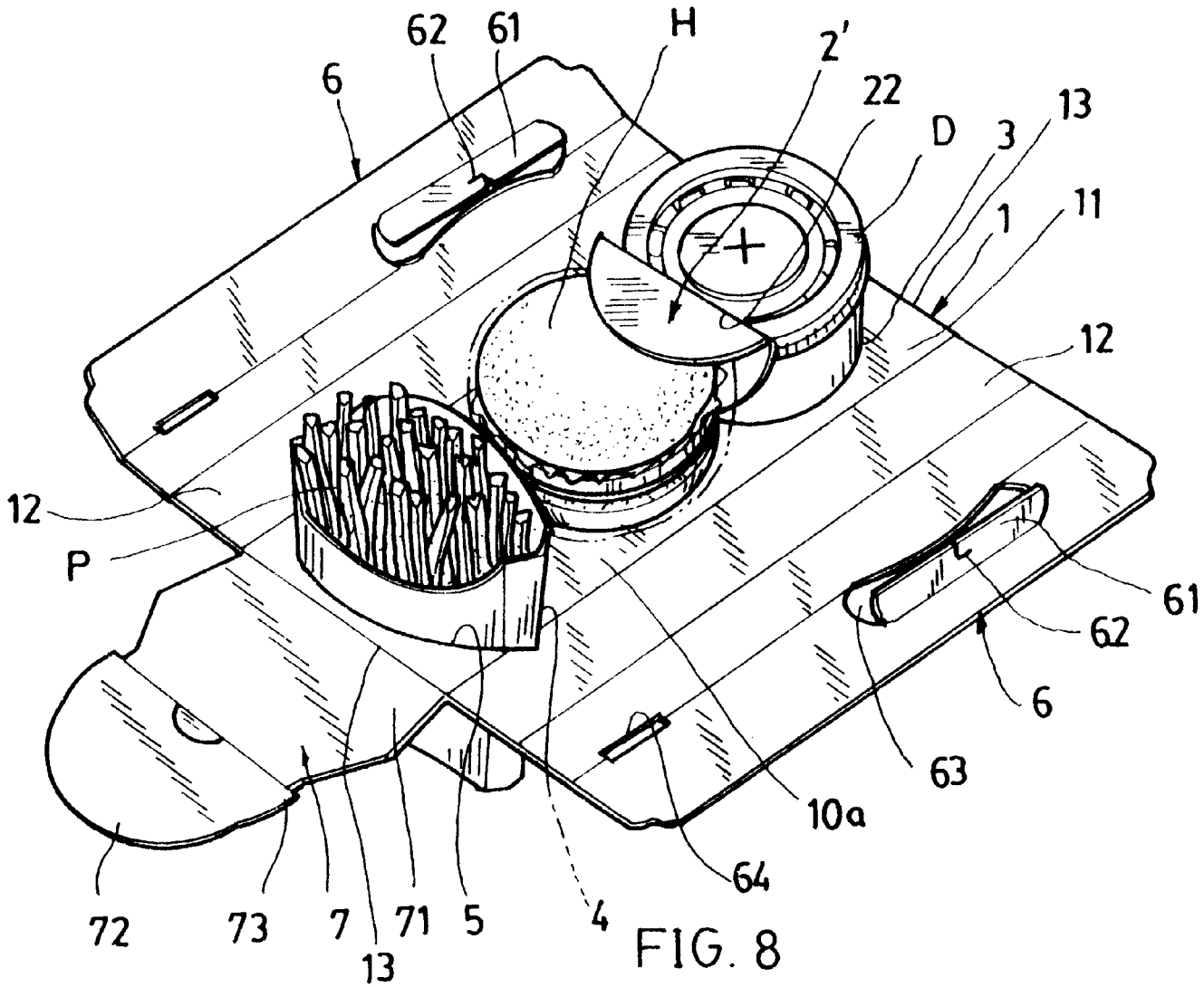
FIG. 8 shows the embodiment loaded with fast foods from FIG. 7.

As shown in FIGS. 5, 6, the engaging slit 64 may be cut in the handle member 6 at a location different from that as shown in FIGS. 3, 4, whereby upon closing of each side cover 7, the locking lug 73 may then be inserted through the slit 64 to be locked in the slit 64 as shown in FIG. 6.

Figure 9:
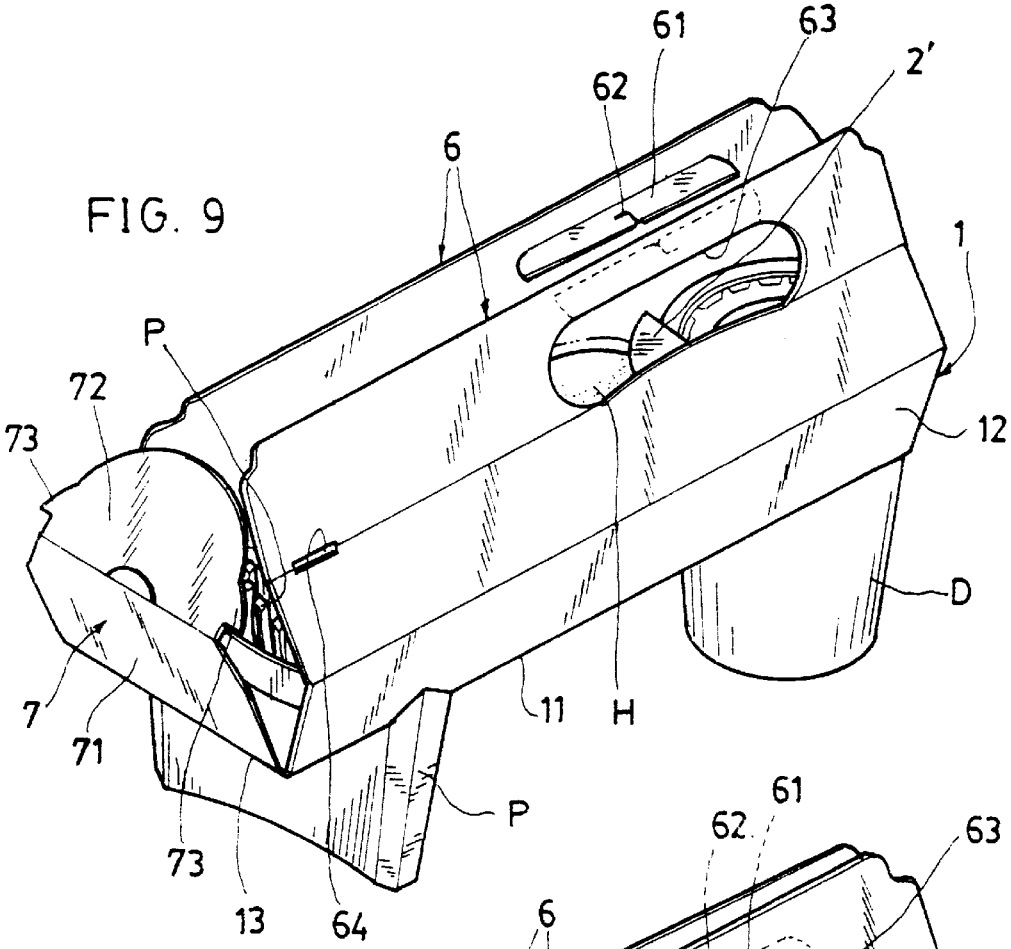
FIG. 9 shows the step for closing the side cover of the present invention when folded from FIG. 8.
Figure 10:
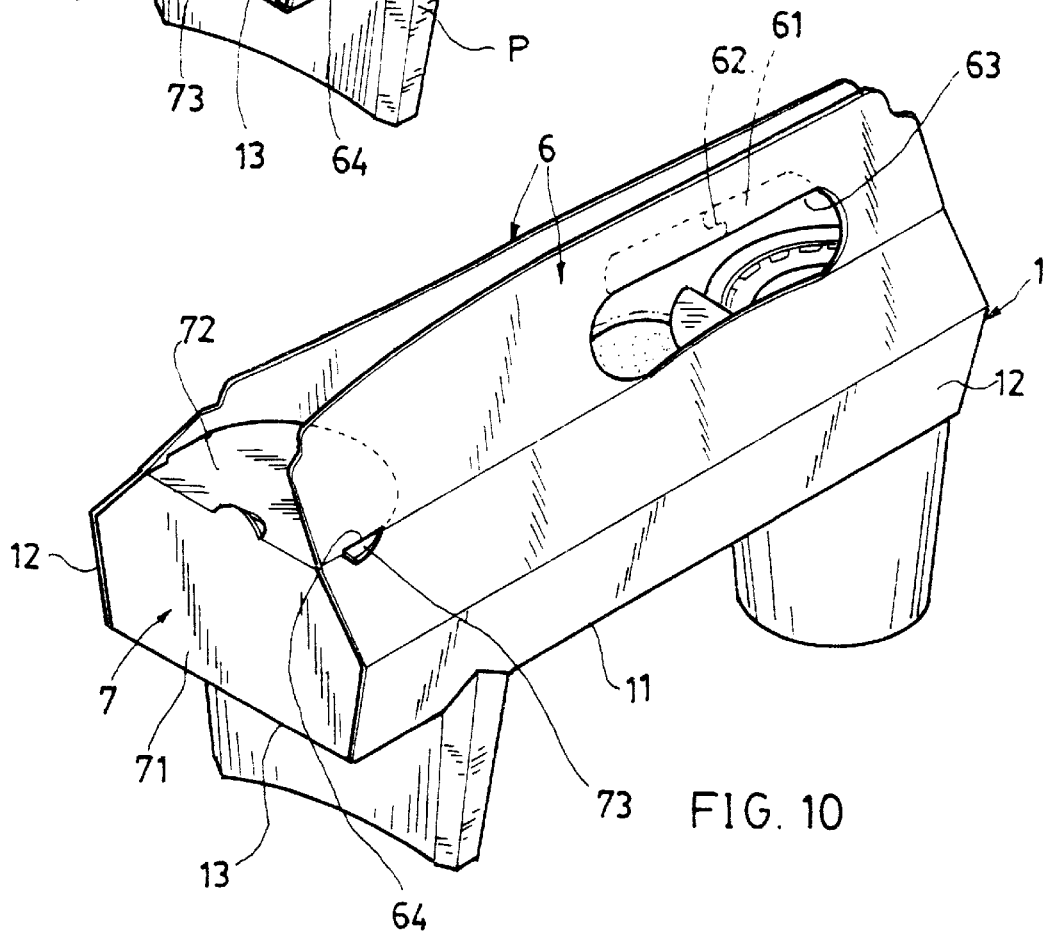
FIG. 10 shows the closed side cover from FIG. 9.

As shown in FIGS. 7~10, still another preferred embodiment of the present invention is made by modifying, re-arranging or changing the locations of several elements of the carrying device, which includes: a partition member 2' of circular shape which is upwardly bent from a circular tearing line 20 as circularly formed on a side (a right) portion of the bottom wall 11 with perforated or dotted line 20; a circular hole 3 formed in the bottom wall along the circular tearing line 20 when tearing the partition member 2' upwardly for loading a cup of soft drink D therein; a flat bottom portion 10*a* formed on a central portion of the bottom wall 11 by bending the circular partition member 2' towards a central portion of the carrying device 1 along a folding line 22; a slot 5 cut out in another side (or left side) portion of the bottom wall 11 for loading a French-fries container P therein; and a side cover 7 having a side lid 71 hingedly secured to a side (left side) edge 13 of the bottom wall 11 having a pair of locking lugs 73 formed on opposite side portions of a top flap 72 protruding from the side lid 71, with the two locking lugs 73 lockable and engageable with two engaging slits 64 formed in the two handle members 6 as shown in FIG. 10.

For gravitational balance, the flap 61 of each handle member 6 is eccentrically formed on a side portion of each handle member 6 corresponding to the circular hole 3 formed in a side portion of the bottom wall since the hole 3 is adapted for loading therein the heavier cup of soft drink D as shown in FIGS. 9, 10.

I claim:

1. A foldable fast-food carrying device comprising:

a paper board or the like having a front wall and a rear wall respectively bent upwardly from a bottom wall; two handle members respectively protruding upwardly from said front wall and said rear wall and operatively interlocked to be carried; two side covers respectively hingedly secured to said rear wall and said front wall and each said side cover operatively folded and locked between said front wall and said rear wall for closing a side opening between said front and rear walls;

a pair of partition members upwardly bent from a circular hole formed in a central portion of said bottom wall, each said partition member having a semi-circular shape, with said circular hole adapted for loading therein a cup of soft drink; and two bottom portions on said bottom wall disposed on opposite sides of the circular hole for respectively storing a hamburger and a container of French-fries of fast food on each said bottom portion, said hamburger or said container of French-fries confined and stably held between each said side cover and each said partition member, each said partition member thermally insulating said soft drink and either said hamburger or said container of French-fries.

2. A fast-food carrying device according to claim 1, wherein said bottom wall is formed with a tearable leaf adjacent to a side edge of the bottom wall along a tearing line formed in the bottom wall, whereby upon a downward protrusion of the tearable leaf along the tearing line, a slot is formed in the bottom wall for loading the container of French-fries in said slot.

3. A fast-food carrying device according to claim 1, wherein each said handle member includes a flap which is formed by cutting out in the handle member to form a handhole or finger hole, each said flap having a locking tab formed in said flap, whereby upon interlocking of two said locking tabs from two said flaps, said two handle members are interlocked to be carried.

4. A fast-food carrying device according to claim 1, wherein each said side cover includes: a side lid hingedly secured to either said rear wall or said front wall along a folding line formed on a side edge of the rear or front wall, a top flap formed on an upper portion of the side lid, and a locking lug formed on an upper portion of the side lid opposite to the folding line of the lid, said locking lug engageable with an engaging slit formed in the other handle member for locking said side cover between said front and rear walls for closing a side opening between said front and rear walls.

5. A fast-food carrying device according to claim 1, wherein said bottom wall has two side extensions respectively formed on opposite side edges of said bottom wall, each said side extension operatively bent upwardly to close a side opening between said front and rear walls in cooperation with each said side cover when closed between said front and rear walls.

* * * * *